US007532101B2

(12) United States Patent
Suzuki

(10) Patent No.: US 7,532,101 B2
(45) Date of Patent: May 12, 2009

(54) TEMPERATURE PROTECTION DEVICE

(75) Inventor: Katsuaki Suzuki, Ryugasaki (JP)

(73) Assignee: Tyco Electronics Raychem K.K., Kanagawa (JP)

( * ) Notice: Subject to any disclaimer, the term of this patent is extended or adjusted under 35 U.S.C. 154(b) by 0 days.

(21) Appl. No.: 10/512,495

(22) PCT Filed: Apr. 24, 2003

(86) PCT No.: PCT/JP03/05282

§ 371 (c)(1),
(2), (4) Date: Jan. 9, 2006

(87) PCT Pub. No.: WO03/092029

PCT Pub. Date: Nov. 6, 2003

(65) Prior Publication Data

US 2006/0197646 A1 Sep. 7, 2006

(30) Foreign Application Priority Data

Apr. 25, 2002 (JP) ..... 2002-124905

(51) Int. Cl.
*H01H 85/04* (2006.01)
*H01H 85/12* (2006.01)
*H01C 7/10* (2006.01)

(52) U.S. Cl. ..... 337/167; 338/22 R; 337/161; 337/182; 337/292

(58) Field of Classification Search ..... 337/167, 337/190, 187, 186, 228, 159, 416, 106, 12, 337/14, 158, 161, 182, 292; 338/22 R
See application file for complete search history.

(56) References Cited

U.S. PATENT DOCUMENTS 4,635,026 A * 1/1987 Takeuchi ..... 338/22 SD (Continued)

FOREIGN PATENT DOCUMENTS

DE 29621154 U1 4/1998

(Continued)

OTHER PUBLICATIONS

Search Report for International Application No. PCT/JP03/05282, mailed Jul. 8, 2003.

(Continued)

*Primary Examiner*—Jayprakash N Gandhi
*Assistant Examiner*—Bradley H Thomas

(57) ABSTRACT

A temperature protection device is provided, which comprises with a polymeric positive temperature coefficient (PTC) device 1 having a conductive polymer 5 placed between two electrodes 6 and 7, and a metal member 2 bonded to one of the electrodes 7 of the polymeric PTC device, and which, when the ambient temperature exceeds a prescribed temperature, terminates the current-flowing state between the other electrode 6 of the polymeric PTC device 1 and the metal member 2. The conductive polymer 5 expands thermally when the ambient temperature exceeds the prescribed temperature, and a material is selected for the metal member 2 that will melt as a result of the heat generated by the conductive polymer during the thermal expansion.

4 Claims, 4 Drawing Sheets

U.S. PATENT DOCUMENTS

| | | | | |
|---|---|---|---|---|
| 4,808,965 | A | 2/1989 | Cenky | 337/408 |
| 5,142,265 | A * | 8/1992 | Motoyoshi et al. | 338/22 R |
| 5,153,555 | A * | 10/1992 | Enomoto et al. | 338/22 R |
| 5,210,517 | A * | 5/1993 | Abe | 338/22 R |
| 5,280,263 | A * | 1/1994 | Sugaya | 338/22 R |
| 5,358,793 | A * | 10/1994 | Hanada et al. | 428/560 |
| 5,363,083 | A * | 11/1994 | Fischer | 337/407 |
| 5,378,407 | A * | 1/1995 | Chandler et al. | 252/513 |
| 5,436,609 | A * | 7/1995 | Chan et al. | 338/22 R |
| 5,712,610 | A * | 1/1998 | Takeichi et al. | 337/290 |
| 5,760,676 | A * | 6/1998 | Yamada | 338/22 R |
| 5,801,612 | A * | 9/1998 | Chandler et al. | 338/22 R |
| 5,907,272 | A * | 5/1999 | McGuire | 338/22 R |
| 5,909,168 | A * | 6/1999 | Miyasaka et al. | 338/22 R |
| 6,222,715 | B1 * | 4/2001 | Gruhn | 361/103 |
| 6,300,859 | B1 * | 10/2001 | Myong et al. | 337/182 |
| 6,351,361 | B1 | 2/2002 | Kawazu et al. | |
| 6,388,553 | B1 * | 5/2002 | Shea et al. | 337/167 |
| 6,489,879 | B1 * | 12/2002 | Singh et al. | 337/167 |
| 6,522,237 | B1 * | 2/2003 | Ito et al. | 338/22 R |
| 6,794,980 | B2 * | 9/2004 | Chu et al. | 338/22 R |
| 6,898,063 | B2 * | 5/2005 | Chu et al. | 361/103 |
| 7,148,785 | B2 * | 12/2006 | Becker et al. | 338/22 R |
| 2002/0109576 | A1 * | 8/2002 | Wang et al. | 338/22 R |
| 2002/0125982 | A1 * | 9/2002 | Swensen et al. | 338/22 R |
| 2004/0136136 | A1 * | 7/2004 | Walsh et al. | 361/106 |
| 2006/0244563 | A1 * | 11/2006 | Koyama et al. | 338/111 |

FOREIGN PATENT DOCUMENTS

| | | | |
|---|---|---|---|
| EP | 0235439 | A1 | 9/1987 |
| EP | 0943150 | B1 | 8/2000 |
| JP | 60-031204 | A | 2/1985 |
| JP | 01-149333 | | 6/1989 |
| JP | 06-349480 | A | 12/1994 |
| JP | 07-326279 | A | 12/1995 |
| JP | 08-138524 | A | 5/1996 |
| JP | 08-172001 | A | 7/1996 |
| JP | 08-236305 | | 9/1996 |
| JP | 2001-216883 | | 8/2001 |
| JP | 2001-216883 | A | 8/2001 |
| WO | WO 87/02835 | A | 5/1987 |
| WO | WO-98/44516 | A1 | 10/1998 |

OTHER PUBLICATIONS

Supplementary European Search Report for European Application No. EP 03723199, mailed May 21, 2007.

* cited by examiner

TEMPERATURE PROTECTION DEVICE

FIELD OF THE INVENTION

This invention relates to a temperature protection device which is a component in a circuit of electrical equipment such as a household appliance and the like and which terminates current flow to the circuit when the ambient temperature exceeds a prescribed temperature in order to ensure the safety of said electrical equipment.

BACKGROUND OF THE INVENTION

Most household appliances use a temperature protection device, which terminates current flow to the circuit when the ambient temperature exceeds a prescribed temperature, thereby securing the safety of the equipment. Enclosed fuses, link fuses, or plug fuses and the like, which are relatively inexpensive, are examples of this type of temperature protection device. However, these generally have low current ratings (around 2 A (amperes)) and cannot be used on household appliances, such as a microwave oven, where the circuit current used is relatively high (around 15-20 A). In such a type of household appliance, a breaker using a bimetal is sometimes used as a substitute for a temperature protection device.

However, this bimetal type breaker has a large number of components and a complex structure; it is extremely expensive compared with the various fuses described above and is one of the causes of increase in the manufacturing cost of household appliances.

SUMMARY OF THE INVENTION

This invention was made in view of the above circumstances and has the purpose of providing a temperature protection device which has a simple structure and which can be procured inexpensively.

In order to resolve the above problem, the following means was adopted.

The temperature protection device of this invention is a temperature protection device, which is provided with a polymeric PTC device comprising a conductive polymer placed between two electrodes and a metal member bonded to one of the electrodes on said polymeric PTC device and which, when the ambient temperature exceeds a prescribed temperature, terminates the current-flowing state between the other electrodes on the above polymeric PTC device and the above metal member, wherein the temperature protection device is characterized by the above conductive polymer being given a characteristic of thermally expanding when the above ambient temperature exceeds the above prescribed temperature, and a material being selected for the above metal member that will melt through the heat generation of the above conductive polymer overheated through thermal expansion.

The conductive polymer is a polymer resin composed by kneading for example polyethylene and carbon black together and crosslinking thereafter with radiation. Within the conductive polymer, the carbon black particles are linked to each other in a room-temperature environment so that numerous conductive paths are formed through which current flows, and good conductivity is exhibited. However, when the conductive polymer expands thermally due to a rise in the ambient temperature or excessive current flowing in the conductive paths, the distances between the carbon black particles are increased, thus severing the conductive paths, and conductivity decreases sharply (the resistance rises sharply). This is called the positive temperature coefficient of a conductive polymer, or PTC. This invention utilizes this characteristic.

First, the temperature protection device of this invention is installed in an electrical equipment circuit in such a way that current flows between the other electrode of the polymeric PTC device and the metal member. When the prescribed current flows in this circuit in a room-temperature environment, the conductive polymer exhibits good conductivity and the current-flowing state of the circuit is ensured.

When the ambient temperature around the circuit comprising the temperature protection device of this invention rises owing to overheating and the like of the electrical equipment, and exceeds a temperature limit set in advance (prescribed temperature), the conductive polymer is affected by heat transfer from the ambient and expands, causing the internal conductive paths to be severed and sharply increasing the resistance. Further, the heat generation of the conductive polymer overheated by increased resistance causes the metal member to melt, breaking the connection between the other electrode of the polymeric PTC device and the current flow is irreversibly broken.

The temperature protection device of this invention functions as described above to ensure the safety of electrical equipment. The structure, consisting of a polymeric PTC device comprising a conductive polymer placed between two electrodes and a metal member having a relatively low melt point, has fewer components compared with a bimetal-type breaker; the structure is also simple and the manufacturing cost can be kept considerably low.

The temperature protection device of this invention is also provided with a first polymeric PTC device comprising a conductive polymer placed between two electrodes, a second polymeric PTC device comprising a conductive polymer similarly placed between two electrodes, a first metal member installed between and bonded to one electrode of the above first polymeric PTC device and one electrode of the above second polymeric PTC device, and a second metal member installed between and bonded to the other electrode of the above first polymeric PTC device and the other electrode of the above second polymeric device, and which, when the ambient temperature exceeds a prescribed temperature, terminates the current-flowing state between one electrode of the above first polymeric PTC device and the other electrode of the above second polymeric PTC device by means of the above first and second metal members, wherein the temperature protection device is characterized by each of the conductive polymers in the above first and second polymeric PTC devices being given a characteristic of thermally expanding when the above ambient temperature exceeds the above prescribed temperature, and a material being selected for the above first and second metal member that will melt through the heat generation of the above conductive polymer overheated through thermal expansion.

The temperature protection device according to another embodiment comprises two polymeric PTC devices, each having a conductive polymer between two electrodes, and two electrodes, and two metal members having a relatively low melt point, so that it has fewer components compared with a bimetal-type breaker and the structure is also simple so that the manufacturing cost can be kept low. Also the current flow paths are in parallel so that it can accommodate electrical equipment with a relatively high circuit current even though it is extremely small in size.

DETAILED DESCRIPTION OF THE INVENTION

Figure 1:
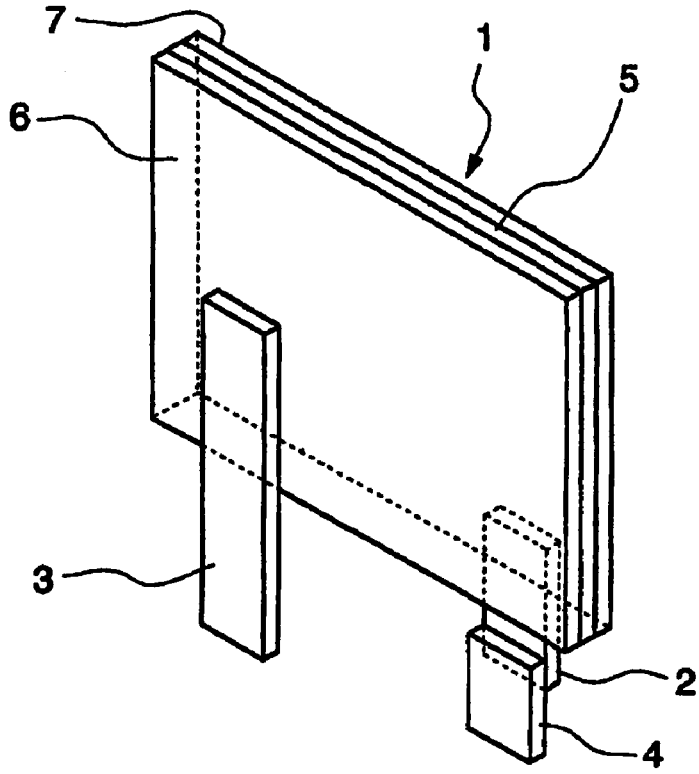
FIG. 1 is a temperature protection device in the first embodiment of this invention, providing a perspective view of the temperature protection device from one side.
Figure 2:
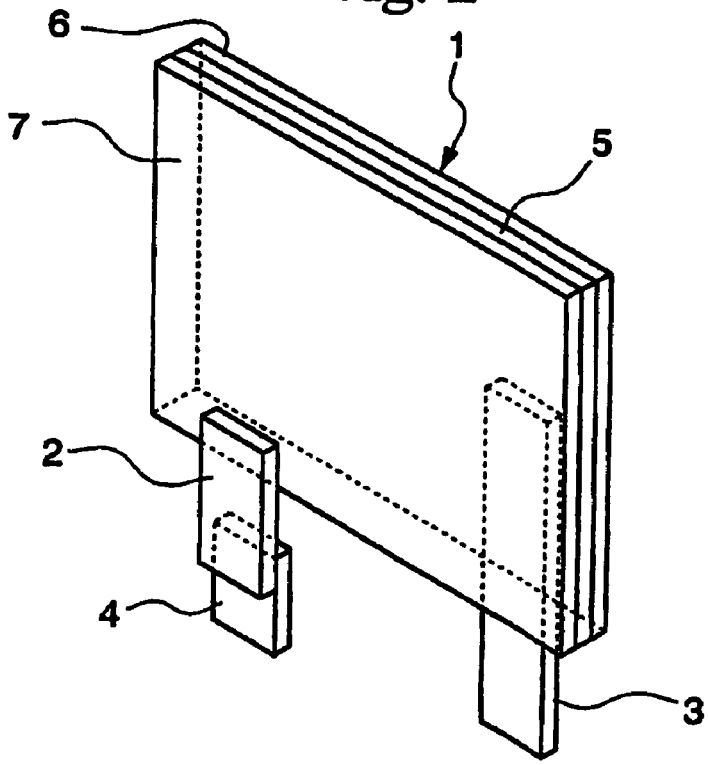
FIG. 2 is a temperature protection device in the first embodiment of this invention, providing a perspective view of the temperature protection device from the other side.

The first embodiment of the temperature protection device of this invention is explained as illustrated in FIG. 1 through FIG. 4. In FIG. 1 and FIG. 2, the element 1 is a polymeric PTC device; 2 is a metal member; 3 and 4 are terminals bonded severally to the polymeric PTC device 1 and the metal member 2 in such a way as to allow current to flow. The polymeric PTC device 1 comprises a rectangular conductive polymer sheet 5 and metallic electrodes 6 and 7 having the same shape and dimensions as the conductive polymer 5 and bonded to the two side surfaces thereof. The polymeric PTC device 1 having such a structure is cut out from a plaque in which nickel foils, which form the electrodes, are compressed on the two surfaces of an unfabricated sheet of conductive polymer having a uniform thickness. The terminals 3 and 4 become connection terminals when installing the temperature protection device of this embodiment in an electrical circuit.

The conductive polymer 5 is a polymeric resin composed by kneading for example polyethylene and carbon black together and crosslinking thereafter with radiation. Within the conductive polymer 5, the carbon black particles are linked to each other in a room-temperature environment so that numerous conductive paths are formed through which current flows, and good conductivity is exhibited. However, the polymer is provided with a characteristic wherein when the conductive polymer expands thermally due to a rise in the ambient temperature or excessive current flowing in the conductive paths, the distances between the carbon black particles are increased, thus severing the conductive paths, and conductivity decreases sharply (i.e. the resistance rises sharply).

The metal member 2 is a material with a relatively low melt point formed into a thin strip, and is bonded to one of the electrodes 7 comprising the polymeric PTC device 1 in such a way as to allow current to pass. The terminal 3 is bonded to the other electrode 6 comprising the polymeric PTC device 1 in such a way as to allow current to flow, and the terminal 4 is bonded to the metal member 2, without being in any way in contact with the polymeric PTC device 1, in such a way as to allow current to flow. These become the connection terminals when installing the temperature protection device of this embodiment in an electrical circuit.

In order that the temperature protection device constructed as described above should, when the ambient temperature exceeds the temperature limit p° C. (prescribed temperature), function to terminate the current-flowing state of the electrical circuit having a circuit current of q A (ampere), the following characteristics are given to the conductive polymer 5 and the metal member 2, which are components of the polymeric PTC device 1.

Figure 3:
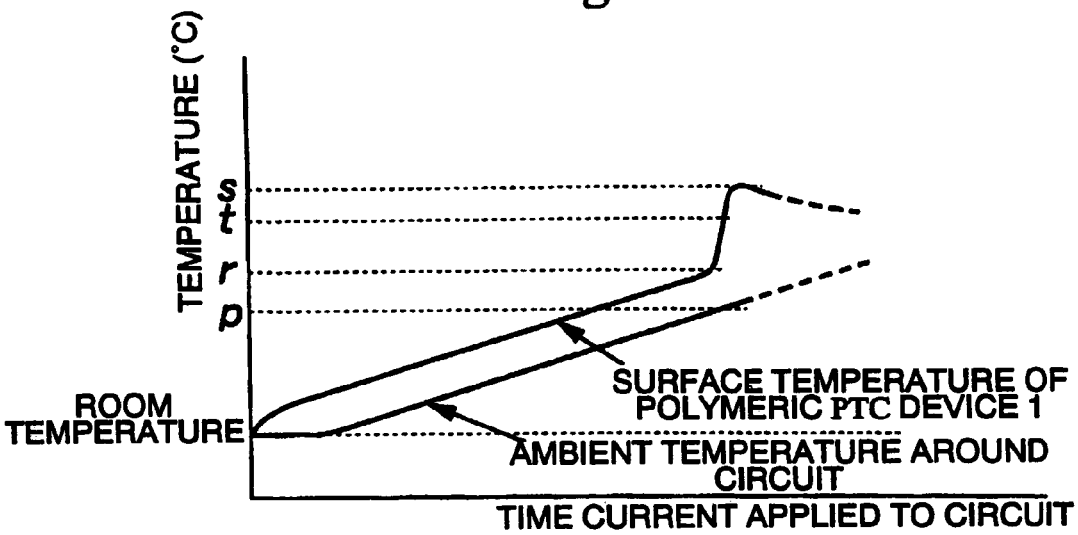
FIG. 3 is a chart showing the relationship between the current applied time and the surface temperature of the polymeric PTC device when the temperature protection device of this invention is installed in an electric equipment circuit.

First, as shown in FIG. 3, the conductive polymer 5 is given a characteristic wherein it generates heat when there is a current flow of q A, which is the circuit current; regardless of the ambient temperature, it maintains its temperature higher than the ambient temperature at that point, and starts thermal expansion when the ambient temperature exceeds the temperature limit of p° C.

More specifically, the conductive polymer 5 creates a small amount of resistance to generate heat when current is applied even when it has not expanded thermally. Thus, the temperature of the conductive polymer 5 in a current-flowing state is always higher than the ambient temperature at that point. If not in a current-flowing state, the temperature of the conductive polymer 5 is only equal to the ambient temperature, but the temperature becomes higher by the amount of heat it generates. In other words, when the ambient temperature reaches the temperature limit p° C., the temperature of the conductive polymer 5 is r° C., which is higher than p° C. Thus, the conductive polymer 5 is given the characteristic of having an actuating temperature of r° C. and starting thermal expansion when its own temperature exceeds r° C.

Further, the conductive polymer 5 is given a characteristic wherein, when it expands thermally and overheats, the amount of heat generation and the amount of heat dissipation reaches equilibrium so that it maintains an approximately constant temperature. The temperature of the conductive polymer 5 when it has reached equilibrium is about s° C., which is higher than the actuating temperature r° C.

Such characteristics are provided by appropriately adjusting the content of carbon black in the conductive polymer and/or the dose of irradiation when crosslinking, and appropriately setting the resistance of the conductive polymer 5 at the time of thermal expansion.

Next, a material is selected as the metal member 2, whose melt point is equal to or higher than the temperature at which the conductive polymer 5 starts thermal expansion (r° C.) and equal to or less than the temperature at which the amount of heat generation and the amount of heat dissipation of the conductive polymer 5 (s° C.) reaches equilibrium. The melt point of the metal member 2 will be denoted as t° C., where $r \leqq t \leqq s$° C.

When the temperature protection device, which is structured as described above and wherein the conductive polymer 5 and the metal member 2, which are components of the polymeric PTC device 1, have been given characteristics as described above, is installed in an electrical circuit of an electrical equipment having a circuit current of q A (ampere) in such a way that current flows between the terminals 3 and 4, and a current of q A is applied to the circuit under a room-temperature environment, the current flows in the order of terminal 3, electrode 6, conductive polymer 5, electrode 7, metal member 2, terminal 4 (or the reverse). The conductive polymer 5, which is a component of the polymeric PTC device 1, exhibits good conductivity under a room-temperature environment and the current-flowing state of the circuit is ensured.

When the ambient temperature around the circuit comprising the temperature protection device of this invention rises, owing to overheating of the electrical equipment and the like, and exceeds the temperature limit p° C., the conductive polymer 5 is affected by heat transfer from the ambient and expands, causing the internal conductive paths to be severed and sharply increasing the resistance. The temperature of the conductive polymer 5, which has overheated owing to increased resistance, exceeds the melt point t° C., which is the melt point of the metal member 2, and moves towards s° C.; its heat generation causes the metal member 2 between the conductive polymer 5 and the electrode 7 to fuse and the current-flowing state between the terminals 3 and 4 is irreversibly broken.

The temperature protection device of this embodiment functions as described above to ensure the safety of electrical equipment that has exceeded the temperature limit. The structure, which comprises a polymeric PTC device 1 having conductive polymer 5 placed between two electrodes 6 and 7, and a metal member 2 having a relatively low melt point, has fewer components compared with a bimetal-type breaker; the structure is also simple and the manufacturing cost can be kept low.

Further, even if the metal member 2 should by chance not fuse and the current-flowing state is continued between the terminals 3 and 4, the conductive polymer 5 will maintain its temperature around s° C., with the amount of heat generation and the amount of heat dissipation in equilibrium, so that there is no risk of the conductive polymer 5 burning away and the electrodes 6 and 7 shorting, making it safe.

Figure 4:
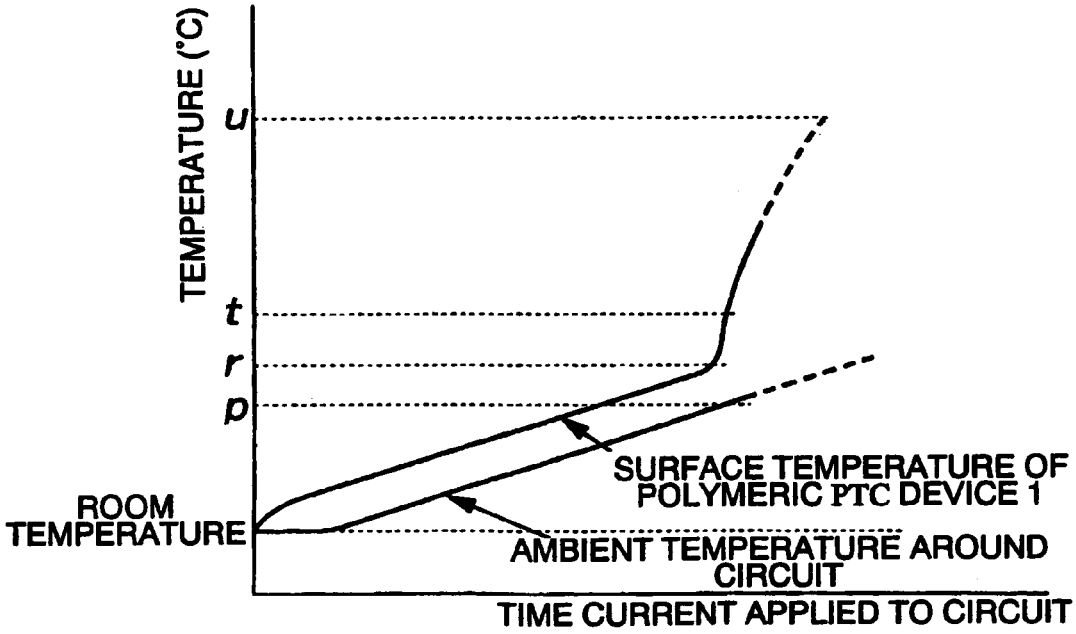
FIG. 4 is a chart showing the relationship between the current applied time and the surface temperature of the polymeric PTC device when the temperature protection device of this invention is installed in an electric equipment circuit.

In the temperature protection device of this embodiment, the conductive polymer 5 is given a characteristic wherein it starts to expand thermally when the ambient temperature exceeds the temperature limit of p° C., and a characteristic wherein when it expands thermally and overheats, the amount of heat generation and the amount of heat dissipation reaches equilibrium and it maintains an approximately constant temperature. Instead of the latter characteristic, the following characteristic may be given to the conductive polymer 5. In other words, as shown in FIG. 4, the characteristic is that the conductive polymer 5, when it expands thermally and overheats, will undergo a thermal runaway so that it will not reach equilibrium but continue to increase the temperature and eventually self-destruct. Self-destruction in this case means that there will be severe oxidation caused by the temperature rise so that the conductive polymer no longer has a PTC characteristic. As in the above description, such a characteristic is provided by appropriately adjusting the content of carbon black in the conductive polymer and/or the dose of irradiation when crosslinking, and appropriately setting the resistance of the conductive polymer 5 at the time of thermal expansion; when compared with a conductive polymer that has been given the characteristic wherein the amount of heat generation and the amount of heat dissipation reaches equilibrium during thermal expansion, the resistance at the time of thermal expansion is kept low.

By providing such a characteristic, there is a wide range between the temperature (r° C.) at which the conductive polymer 5 starts thermal expansion and the temperature (u° C.) at which it undergoes a thermal runaway and self-destructs. When selecting the metal member 2, a material may be adopted that has a melt point in this temperature range, so that the range of material selection is widened and a more inexpensive material may be selected. Also, by keeping the resistance at the time of thermal expansion low, the voltage applied between the electrodes 3 and 4 at the time of thermal expansion may be suppressed, as a result of which, the temperature protection device may also be used in a higher voltage circuit.

In the temperature protection device of this embodiment, the conductive polymer 5 may additionally be given a characteristic wherein it generates heat when an overcurrent far exceeding q A flows between the terminals 3 and 4, and increases its temperature to a higher temperature than the melt point of the metal member 2. By adding such a characteristic, the conductive polymer 5 will generate heat through Joule heat and expand thermally if an overcurrent flows for any reason even under a room-temperature environment; the metal member 2 will melt and break between the electrode 7 through the heat generation of the overheated conductive polymer 5, and the current-flowing state will be irreversibly broken. In other words, in addition to its original function as a temperature protection device, the function of an overcurrent protection device is also provided, considerably enhancing its versatility.

Figure 5:
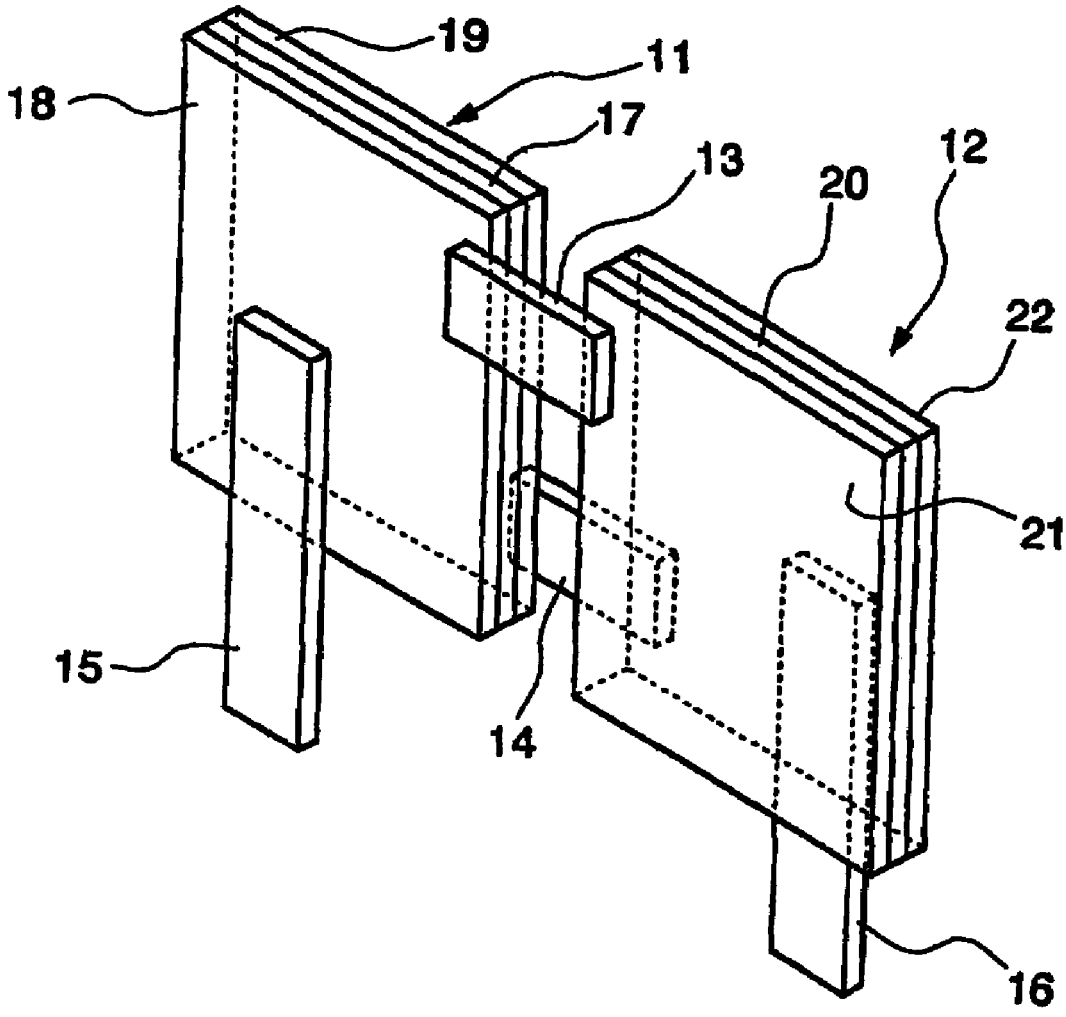
FIG. 5 is a temperature protection device in the second embodiment of this invention, providing a perspective view of the temperature protection device from one side.
Figure 6:
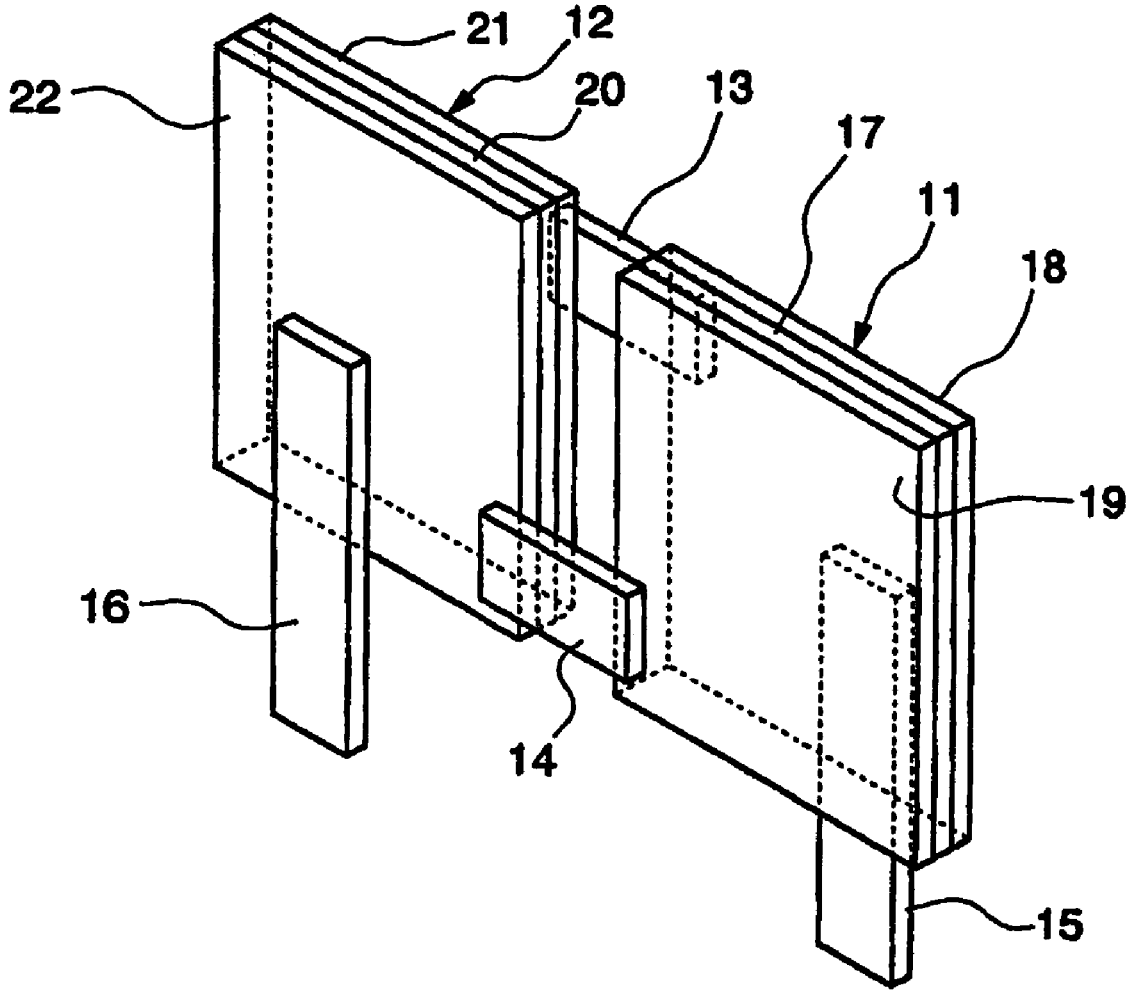
FIG. 6 is a temperature protection device in the second embodiment of this invention, providing a perspective view of the temperature protection device from the other side.

The second embodiment of the temperature protection device of this invention is explained as illustrated in FIG. 5 and FIG. 6. Components already described in the above first embodiment have been given the same element number and explanations are omitted.

In FIG. 5 and FIG. 6, the elements 11 and 12 are both polymeric PTC devices (first and second polymeric PTC devices); 13 and 14 are both metal members (first and second metal members); 15 and 16 are terminals bonded respectively to the polymeric PTC devices 11 and 12. The structure and shape of the polymeric PTC devices are the same as those described in the first embodiment above; the polymeric PTC device 11 comprises a rectangular conductive polymer sheet 17 and metallic electrodes 18 and 19 having the same shape and dimensions as the conductive polymer 17 and bonded to the two side surfaces thereof, and the polymeric PTC device 12 comprises a rectangular conductive polymer sheet 20 and metallic electrodes 21 and 22 having the same shape and dimensions as the conductive polymer 17 and bonded to the two side surfaces thereof. The two polymeric PTC devices 11 and 12 are positioned in the same plane each with a side parallel to and separated from the other.

The metal member 13 is a material with a relatively low melt point formed into a thin strip, and is placed between one of the electrodes 18 of the polymeric PTC device 11 and one of the electrodes 21 of the polymeric PTC device 12 and bonded to each in such a way as to allow current to pass. The metal member 14 is placed between the other electrode 19 of the polymeric PTC device 11 and the other electrode 22 of the polymeric PTC device 12 and bonded to each in such a way as to allow current to pass. The two metal members 13 and 14 are placed as distanced from each other as possible.

The terminal 15 is bonded to the electrode 11 of the polymeric PTC device 11, without being in any way in contact with the metal member 13, in such a way as to allow current to flow, and the terminal 16 is bonded to the electrode 22 of the polymeric PTC device 12, without being in any way in contact with the metal member 14, in such a way as to allow current to flow. These become the connection terminals when installing the temperature protection device of this embodiment in an electrical circuit.

In order that the temperature protection device structured as described above should, when the ambient temperature exceeds the temperature limit p° C., function to terminate the current-flowing state of the electrical circuit having a circuit current of q A (ampere), the conductive polymers 17 and 20 and the metal members 13 and 14, which are components severally of the polymeric PTC devices 11 and 12, are given the same characteristics as the conductive polymer 1 and the metal member 2, which are components of the polymeric PTC device 1 in the first embodiment above (see FIG. 3).

The temperature protection device structured as described above, with the conductive polymers 17 and 20 and the metal members 13 and 14, which are components severally of the polymeric PTC devices 11 and 12, being given characteristics as described above, is installed in the circuit of electrical equipment having a circuit current of q A (ampere) in such a way that current flows between the terminals 15 and 16. When current of q A is applied to this circuit under a room-temperature environment, the current is divided into two, flowing in parallel; one current flows in the direction of terminal 15, electrode 18, metal member 13, electrode 21, conductive polymer 20, electrode 22, metal member 2, and terminal 16 (or the reverse), while the other current flows in the direction of terminal 15, electrode 18, conductive polymer 17, electrode 19, metal member 14, electrode 22, and terminal 16 (or the reverse). The conductive polymers 17 and 20, which are components of the polymeric PTC devices 11 and 12 exhibit good conductivity in a room-temperature environment, and the current-flowing state of the circuit is ensured.

When the ambient temperature around the circuit comprising the temperature protection device of this invention rises, owing to overheating of the electrical equipment and the like, and exceeds the temperature limit p° C., the conductive polymers 17 and 20 are affected by heat transfer from the ambient and expand, causing the internal conductive paths to be severed and sharply increasing the resistance. The temperature of the conductive polymers 17 and 20, which have overheated owing to increased resistance, exceeds the melt point t° C., which is the melt point of the metal members 13 and 14, and moves towards s° C.; the heat generation causes the metal member 13 between the electrodes 18 and 21 to fuse and the current-flowing state between the terminals 15 and 16 is irreversibly broken.

The temperature protection device of this embodiment functions as described above to ensure the safety of electrical equipment that has exceeded the temperature limit. The structure, which comprises two polymeric PTC devices 11 and 12 and metal members 13 and 14 having a relatively low melt point, has fewer components compared with a bimetal-type breaker; the structure is also simple and the manufacturing cost can be kept low.

Further, even if the metal members 13 and 14 should by chance not fuse and the current-flowing state is continued between the terminals 15 and 16, the conductive polymers 17 and 20 will maintain their temperature around s° C., with the amount of heat generation and the amount of heat dissipation in equilibrium, so that there is no risk of the conductive polymers 17 and 20 burning away and the electrodes 21 and 22 shorting, making it safe.

Further, the temperature protection device of this invention is so structured that the current flow paths are in parallel; thus it can accommodate electrical equipment with a relatively high circuit current even though it is extremely small in size.

Also in the temperature protection device of this embodiment, the conductive polymers 17 and 20 may be given a characteristic wherein they will undergo a thermal runaway when they expand thermally and overheat, so that they will not reach equilibrium but continue to increase the temperature and eventually self-destruct (see FIG. 4). Through this also, the range of material selection is widened when selecting the metal members 13 and 14, and a more inexpensive material may be selected. Further, the temperature protection device may also be used in a higher voltage circuit.

Also in the temperature protection device of this embodiment, the conductive polymers 17 and 20 may additionally be given a characteristic wherein they generate heat when an overcurrent far exceeding q A flows between the terminals 15 and 16 and increase their temperature to a higher temperature than the melt point of the metal members 13 and 14. Through this also, in addition to its original function as a temperature protection device, the function of an overcurrent protection device is also provided, considerably enhancing its versatility.

What is claimed is:

1. A temperature protection device, which is provided with a first polymeric positive temperature coefficient (PTC) device comprising a conductive polymer placed between first and second electrodes, a second polymeric PTC device comprising a conductive polymer placed between third and fourth electrodes, a first metal member installed between and bonded to the first electrode of the first polymeric PTC device and the third electrode of the second polymeric PTC device, and a second metal member installed between and bonded to the second electrode of the first polymeric PTC device and the fourth electrode of the second polymeric device, and which, when the ambient temperature exceeds a prescribed temperature, terminates the current-flowing state between the first electrode of the first polymeric PTC device and the fourth electrode of the second polymeric PTC device by means of the first and second metal members, wherein the conductive polymers of the first and second polymeric PTC devices thermally expand when the ambient temperature exceeds the prescribed temperature, and the first and second metal members comprise a material that will melt as a result of heat generated when the conductive polymer thermally expands.

2. A temperature protection device according to claim 1 wherein the first polymeric PTC device comprises a conductive polymer comprising polyethylene and carbon black.

3. A temperature protection device according to claim 2 wherein the conductive polymer is crosslinked.

4. A temperature protection device according to claim 1 wherein the first, second, third, and fourth electrodes comprise nickel foil.

* * * * *